US005375503A

United States Patent [19]

Breugnot et al.

[11] Patent Number: 5,375,503

[45] Date of Patent: Dec. 27, 1994

[54] BLANKING-OFF ELEMENT FOR A MUNITION LAUNCHING TUBE AND A LAUNCHING TUBE COMPRISING IT

[75] Inventors: Jean-Pierre Breugnot, Montrouge; Jean-Paul Demay, Fresnes, both of France

[73] Assignee: Aerospatiale Societe Nationale Industrielle, Paris, France

[21] Appl. No.: 82,752

[22] Filed: Jun. 24, 1993

[30] Foreign Application Priority Data

Jun. 26, 1992 [FR] France ..... 92 07905

[51] Int. Cl.[5] ..... F41F 3/04

[52] U.S. Cl. ..... 89/1.817; 89/1.8

[58] Field of Search ..... 89/1.817, 1.818, 1.810, 89/1.812, 1.8

[56] References Cited

U.S. PATENT DOCUMENTS

| | | | |
|---|---|---|---|
| 4,134,328 | 1/1979 | Asp et al. | 89/1.817 |
| 4,263,835 | 4/1981 | Dragonuk | 89/1.817 |
| 4,455,917 | 6/1984 | Shook | 89/1.817 |
| 4,471,684 | 9/1984 | Johnson et al. | 89/1.817 |
| 4,498,368 | 2/1985 | Doane | 89/1.817 |
| 4,970,937 | 11/1990 | Ward | 89/1.817 |
| 4,986,188 | 1/1991 | Denis et al. | 89/1.817 |
| 5,062,345 | 11/1991 | Tegel et al. | 89/1.810 |

FOREIGN PATENT DOCUMENTS

| | | |
|---|---|---|
| 670538 | 2/1966 | Belgium . |
| 809156 | 7/1949 | Germany . |
| 2639719 | 3/1978 | Germany . |
| 933957 | 8/1963 | United Kingdom . |
| 2074296 | 10/1981 | United Kingdom . |
| 2218785 | 11/1989 | United Kingdom . |

*Primary Examiner*—David Brown
*Attorney, Agent, or Firm*—Remy J. VanOphem

[57] ABSTRACT

A blanking-off element, intended to be mounted on one end of a tube for storing and launching a munition to protect its interior from external attacks, embodies a cap intended to extend over the entire section of the tube end and to be fixed in a tight manner right along the edge of the tube end and to become detached at least partially with respect to the end at the moment of launching, characterized in that the cap is fixed to the interior of a protective cover made from pliable material which has a retaining lug fixed to the outside of the tube close to the end, whereby the cap is recovered by the protective cover at the moment of launching.

24 Claims, 4 Drawing Sheets

BLANKING-OFF ELEMENT FOR A MUNITION LAUNCHING TUBE AND A LAUNCHING TUBE COMPRISING IT

BACKGROUND OF THE INVENTION

1. Field of the Invention

The invention relates to the blanking off or covering of the end of a launching tube, which in practice is mobile, for a missile, rocket or similar munition.

2. Description of the Prior Art

As is known, there are tubes or boxes which are used both for storing a munition and also for its launching. In order to avoid, before launching, any penetration into the tube of undesirable products likely to disturb the launching phase, sometimes with dramatic consequences, it is known to equip the launching tube, after having introduced the munition, with caps by blanking off the front and rear ends. In this manner, including possible operations in a hostile environment, the operator now only has to check the completeness of the caps to ascertain at the moment of firing the correct state of cleanliness of his weapon.

These caps or blanking-off elements may be of several types, depending on whether their detachment with respect to the tube end which they blank off occurs automatically before firing (one sometimes speaks of "doors") or at the very beginning of firing.

The first case corresponds most frequently to heavy weapons in practice configured as a battery. Thus, for example, French Patent No. 2,626,808, which relates to missile containers especially on board battleships, and French Patent No. 2,555,725, which relates to missile systems "containerized" on vehicles, on land or on ship, provide for articulated covers or doors.

The second case corresponds in practice to light weapons, for example carried and manipulated by their operator. The detachment of the front end of the launching tube is then performed by the ejection fragmentation of the blanking-off element. In fact, there are several cases in which ejection or fragmentation results from the action of a pyrotechnical element or an explosive cord triggered at the moment of firing (see for example French Patent No. 2,555,725 and U.S. Pat. Nos. 4,301,708 and 3,962,951), from the pressure of the gases caused by the firing (see in particular German Patent No. 1,016,603, European Patent No. 0,022,756 and French Patent No. 2,230,955) or the thrust exerted by the nose itself of the munition being launched (see in particular European Patent No. 0,434,938, French Patent Nos. 1,436,333 and 2,038,112, British Patent No. 1,206,945 and U.S. Pat. No. 4,498,368). When there is fragmentation, the retention of all or part of the fragments may be provided for at the periphery of the end of the tube in question (see for example the above-mentioned French Patent No. 1,436,333 and U.S. Pat. No. 4,498,368, or again the above-mentioned French Patent No. 2,620,808 which provides for a substantial reblanking-off of the rear end of missile launching containers mounted in battery).

These various known solutions, with the detachment of the ends at the very moment of firing, have the drawback of inevitably producing debris, which is ejected in an uncontrolled manner, and compromises the level of protection which the blanking-off element in question has to ensure. Furthermore, these solutions are normally complex.

The object of the invention is to alleviate the above-mentioned disadvantages thanks to a blanking-off element for at least one of the ends, especially the front end, of a munition storage and launching tube, which is preferably portable, and which may, despite its simple construction, ensure in the storage phase, in combination with the tube itself, a high and lasting level of protection in the course of time with respect to climatic, mechanical, electromagnetic, nuclear, biological and/or chemical attacks, while guaranteeing in a reliable manner, even after a long storage period (which may typically reach, or even exceed, 10 years), the complete clearance of the end under the action of the pressure front occurring at the moment of firing, and without the uncontrolled ejection of debris and without any risk to the operator of the tube.

SUMMARY OF THE INVENTION

For this purpose the invention proposes a blanking-off element intended to be mounted on one end of a munition storage and launching tube to protect its interior from external attacks. The blanking-off element essentially embodies a cap intended to extend over the entire section of the tube end and to be fixed in a tight manner right along the edge of the tube end and to become detached at least partially with respect to the end at the moment of launching. The cap is fixed to the interior of a protective cover made from pliable material which has a retaining lug fixed to the outside of the tube close to the end, whereby the cap is recovered at the moment of launching by the protective cover.

In this manner, when the cap becomes detached at least partially from the end of the tube, it is, in its entirety, retained at the tube due, primarily, to the lug of the protective cover. Therefore, there is no uncontrolled ejection of debris. The cap is in practice made of rigid material so as to ensure the desired level of protection, especially mechanical, whereas the protective cover may provide this cap with protection from sound and light (i.e. may be used to absorb any incident sound or light wave, the transmission of which would betray the presence of the weapon). It will be appreciated that the invention is contrary to the prior art of conserving an attachment symmetry of the cap with respect to the axis of the tube.

According to the preferred teachings of the invention, which may optionally be combined:

the cap has a bottom wall and a skirt intended to run along the outside of the tube end and to be fixed thereto;

the cap includes, between the bottom wall and the skirt, an annular zone of less resistance;

the annular zone of less resistance is a right-angled connection zone produced by stamping between the skirt and the bottom wall;

the cap is fixed to the protective cover by only its bottom wall;

the cap is fixed to the protective cover by adhesive, which is heat-meltable;

the attachment lug is connected to an annular band intended to surround the tube end;

the cover runs circumferentially along the annular band;

the cover and the annular band are, in addition to the lug, connected by frangible zones (easy to break);

the pliable material of the protective cover is thermo-retractable;

the pliable material is polyethylene;

the cap is made from an electrically conductive material, which may be copper based.

The invention also relates to a launching tube equipped at one, and preferably at each, end with such a blanking-off element. When the tube embodies an electrically conductive metal wall, the cap is also preferably electrically conductive, the bond between the wall (optionally bare close to the end) and the cap being advantageously made by an electrically conductive adhesive. At the front end, the blanking-off element is preferably connected to the tube by an annular band, to which is connected the lug of the cover whereas, at the rear end, the lug of the cover may alone ensure attachment to the tube.

Other features, objects, and advantages of the invention will become apparent from the following description, given as a non-restrictive example, with reference to the attached drawings.

DETAILED DESCRIPTION OF THE PREFERRED EMBODIMENT

Figure 1:
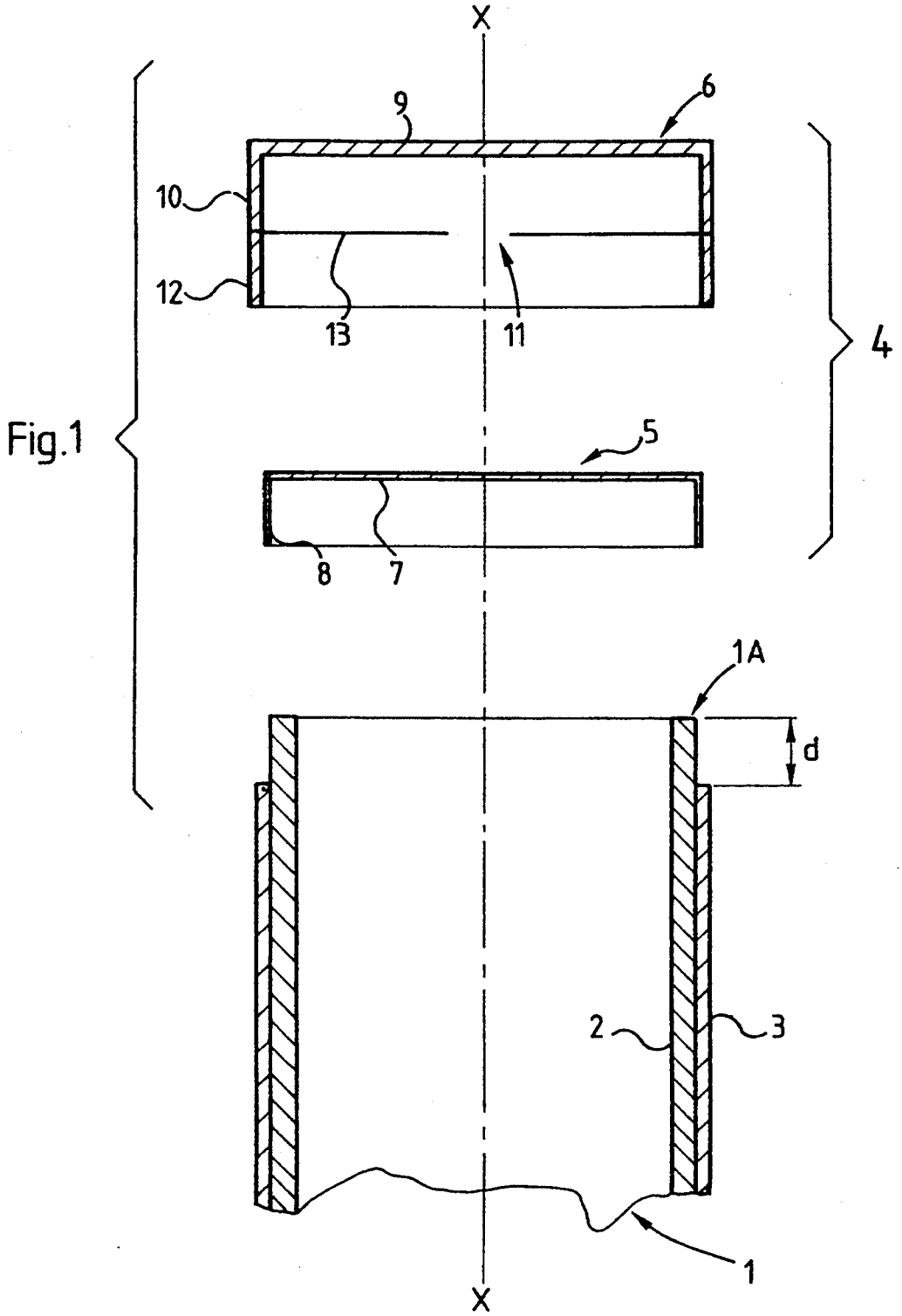
FIG. 1 is an exploded cross-sectional view of the front end of a launching tube and its blanking-off element.

FIG. 1 represents an end 1A, preferably the front end, of a launching tube, designated in its entirety by the reference 1, which is used to store a munition such as a missile, rocket or the like and then to launch it. This tube per se, with its munition (not shown), is of any appropriate known type and will not be described in detail.

It will just be stated here that the tube, which is preferably portable, is formed at its front end from a cylindrical steel strip 2, which is a conductor of electricity having an axis X—X, surrounded by an external wall 3. By way of example, the strip is made from copper and the external wall is a winding of carbon fibers.

The external wall advantageously stops at a short distance from the free edge or border of the strip so as to leave it bare over third short distance.

The copper strip contributes in particular to the mechanical strength of the tube and its electromagnetic screening.

A blanking-off element, designated in its entirety by the reference 4, and formed by a cap 5 and a protective cover 6 made pliable material, is mounted on the end 1A of the tube.

The cap 5, which is intended to blank off the section of the end 1A in a tight manner, has a bottom wall 7, in practice plane, extending over the entire section of the end 1A and is fixed in a tight manner right along the edge of the end by a skirt 8, which here is cylindrical, intended to run along the outside of the end of the tube, preferably over all or part of the distance d on which the metal strip 2 is left bare. The cap 5 is advantageously obtained by stamping.

The cap is preferably a conductor of electricity (here made from copper), just like the strip, so as to enable the electromagnetic continuity of the tube-cap.

The integration of the cap with the tube is preferably ensured by the skirt 8, by crimping, gluing or welding. In the example in question, the connection is ensured by adhesive, which is advantageously conductive, so as to reinforce the above-mentioned electromagnetic continuity. The existence of the skirt enables a tight and very good mechanical attachment.

The cap 5 is fixed to the interior of the protective cover 6, preferably by its single bottom wall, which enables the avoidance of the risk of the attachment material, for example adhesive (advantageously heat-meltable) flowing over onto the actual tube.

The cover 6 also has a bottom wall 9 connected at its periphery to a cylindrical skirt 10 running alongside the skirt 8 of the cap, preferably over a distance at least equal to the axial dimension of the skirt 8 of the cap so as to well define the cap and to extend around the actual tube. The fact that there is no adhesive between the skirts 10 and 8 prevents the skirt 10 from becoming stuck at the wrong moment to the tube itself.

The skirt 10 is axially extended opposite the bottom wall 9 by a lug 11 fixed on the outside to the tube at a predetermined distance from the end.

More precisely, the lug is preferably extended circumferentially so as to form an annular band 12 intended to surround the tube beyond the bare zone.

Figure 6:
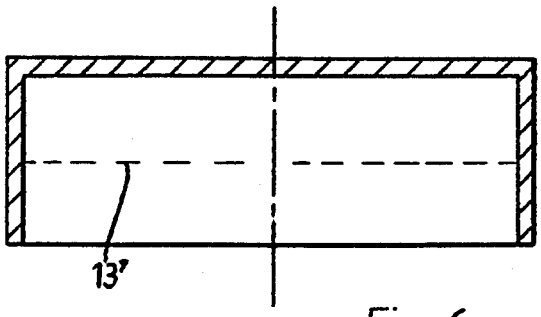
FIG. 6 is another embodiment of the cover of FIG. 1.

In a preferred manner the annular band runs along the skirt 10 so as only to be separated from it by a slit 13 extending over an angular sector of less than 360° so as to leave the lug 11 on an angular range (for example of between 20° and 50°, preferably 40°) which is adequate to enable the lug 11 to withstand the wrenching force during the ejection of the cap. This slit does not need to be complete, i.e. it may extend over just one part of the skirt 10 including the annular band, or be stippled with the condition that it provides an unclosed frangible zone (for example, of less thickness), such as line 13' of FIG. 6.

Here the protective cover 6 is fixed to the tube by adhesion right along the annular band, for example by the same heat-meltable adhesive as that used to fix the bottom walls of the cap and of the cover.

Figure 2:
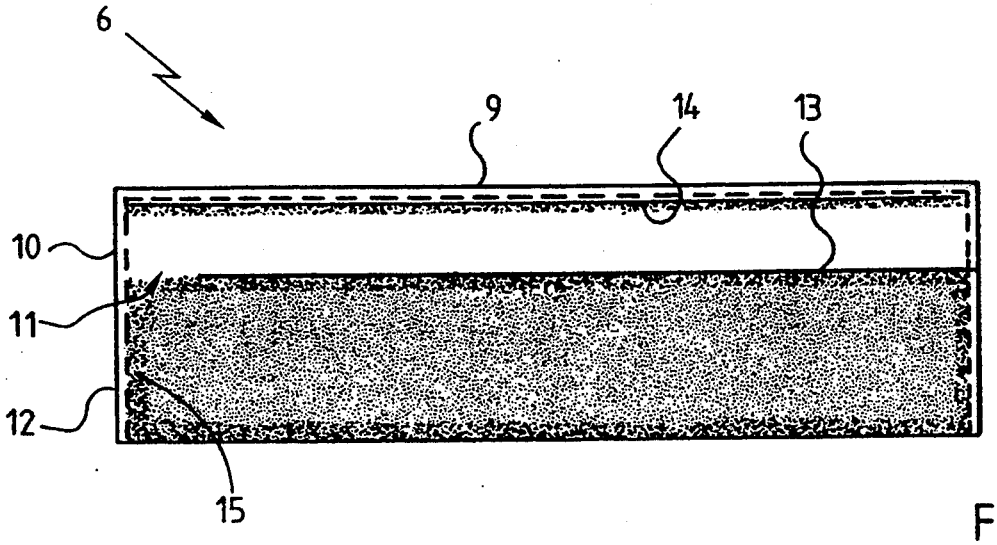
FIG. 2 is an elevated view on a larger scale of the protective cover in FIG. 1, after a rotation of 90° about the axis of the tube.

FIG. 2 represents the cover 6 with preglued coatings 14 and 15.

The cover is preferably made from a thermo-retractable material, polyethylene for example.

Figure 3:
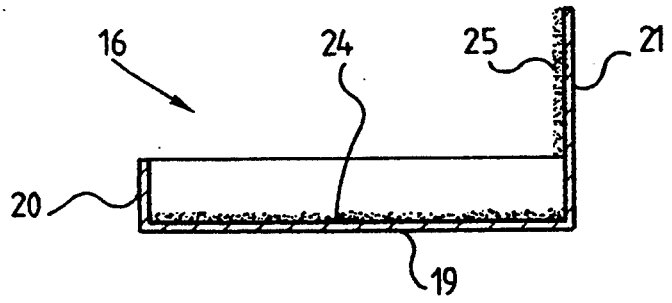
FIG. 3 is a cross-sectional view of the cover of the blanking-off element of the rear end of the tube in FIG. 1.
Figure 4:
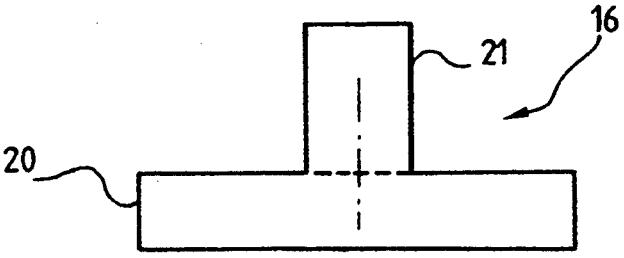
FIG. 4 is an elevated view, after a rotation of 90° about the axis of the tube, of the cover in FIG. 3.

FIGS. 3 and 4 represent another cover 16 intended to receive a cap (not shown) of the same type as the cap 5 of FIG. 1. The blanking-off element thus formed, which in particular can be used for the rear end of the tube 1, only differs from that in FIG. 1 in that a bottom wall 19 and a skirt 20 of the cover 16 are connected to the tube by a simple lug 21, having a constant circumferential dimension as shown clearly in FIG. 4. Pregluing zones are designated in FIG. 3 by the references 24 and 25. In this case the lug is advantageously non-retractable.

Figure 5:
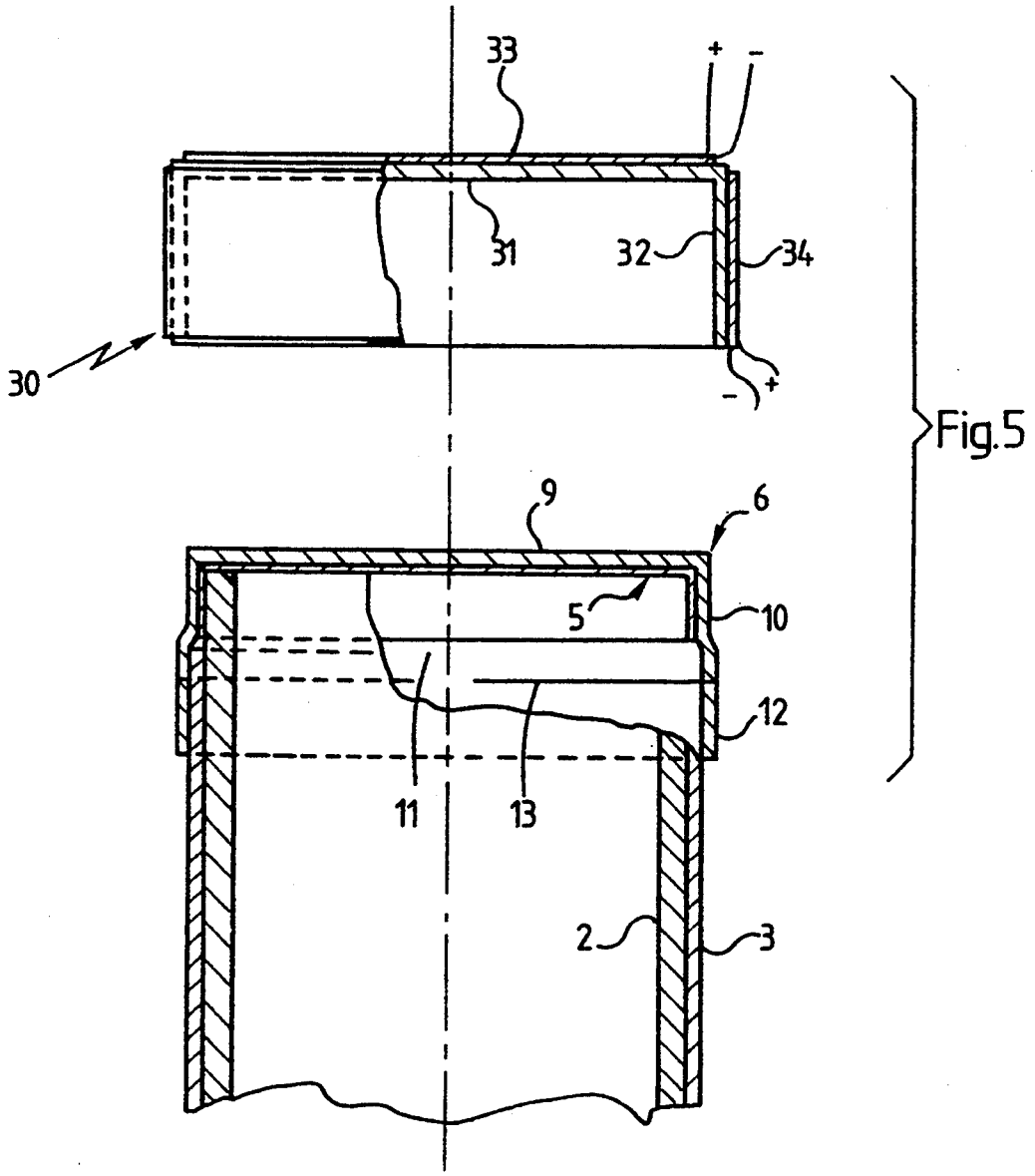
FIG. 5 is a cut-away cross-sectional view of the end of the tube and of the blanking-off element in FIG. 1 and of a set of tools to attach this element onto the tube end.

For the assembly (see FIG. 5) of the blanking-off element 4 on the end 1A, the following operations can be followed, after optionally having made the strip 2 bare in the immediate proximity of the edge:

a. The cap 5 is put into position after having put the electrically conductive adhesive between the bare part of the strip and the skirt 8 of the cap;

b. the cover 6, which has previously been glued and cut, is put into position on the cap and the tube.

c. on and around the cover 6 is put into place a gluing and retraction tool represented at 30 in FIG. 5, having a bottom wall 31 and, integral with the wall made from a series 2000 aluminum alloy (for example 2024, i.e. an Al-Cu alloy), a skirt 32, along the outside of both of which run heating resistors 33 and 34 immersed in a polymerized resin on the wall and the skirt;

d. the heating resistors 33 and 34 are supplied with electricity, which ensures:
the polymerization of the conductive adhesive; and the retraction of the cover 6 on the cap and the tube and also the fusion of the heat-meltable adhesive.

A pressure stress may be applied radially to the tube-cap junction, for example thanks to the retraction of the cover, which avoids having to maneuver the gluing tool.

Operation d may be performed in a relatively short time (30 seconds, for example).

As a variant, by acting on the coefficient of expansion of the polyethylene, the sequence of stages is modified as follows: before mounting the cover on the cap, it is oven-baked for 10 mn to 100° C., for example; after positioning it on the cap and on the tube, the polyethylene is left to retract in the open air, with the prepolymerization of the conductive adhesive.

Therefore there is no longer any necessity for a set of tools.

Then one proceeds with a final treatment completing the polymerization of the conductive adhesive.

By way of example, the cover is made from polyethylene supplied by RAYCHEM in Denmark, or by HELLERMANN, in England; the set of tools is obtained from WATLOW France (at Pontoise), which imports it from Germany (WAHOW, FRG) whereas the conductive adhesive, for example, on a base of silver particle, is obtained from RAYCHEM under the reference CHOBOND 584-29; the heat-meltable adhesive is obtained from RAYCHEM under reference S 1112 or from HELLERMANN under reference WM 250.

The cap has for example a thickness of 0.1 mm and a final diameter of 168 mm and a skirt height of 6 mm. The cover in FIG. 2 has a thickness of 1.5 nm, a retraction temperature less than or equal to 150° and a skirt height of 20 mm, i.e. greater than the above-mentioned height of the skirt of the cap; the annular band has a height of 30 mm.

As a matter of fact on FIG. 5 it is noticed that the slit 13 is located beneath the free edge of the skirt of the cap, preferably opposite the external wall 3 protecting the strip 2.

The mass of the front and rear elements of the tube is typically at most 100 g.

Such a blanking-off element has withstood in particular dry heat (+71° C.), the cold (−46°), corrosion in particular by caustic soda (2% aqueous solution), boric acid (1.7% aqueous solution) or by concentrated freon.

Closest to the moment of its use, the (classical) tube is equipped with its accessories which allow firing (tripping device, viewfinder. . . ).

During the missile firing sequence, the missile battery and the gyroscopes are activated and the launching device of the gyroscopes creates excess pressure in the launching tube. The front and rear caps 5 and 5' of FIG. 7 withstand this excess pressure.

The ignition of the launching propulsion units causes a pressure wave, one part of which is deflected by the rear cap, permitting the breaking of the front cap which is recovered by its protective cover, which remains connected to the launching tube.

At the beginning of the ignition phase of the propulsion units, the rear cap withstands a rise in pressure before being broken and recovered by its protective cover, everything remaining inside the security cone.

Figure 7:
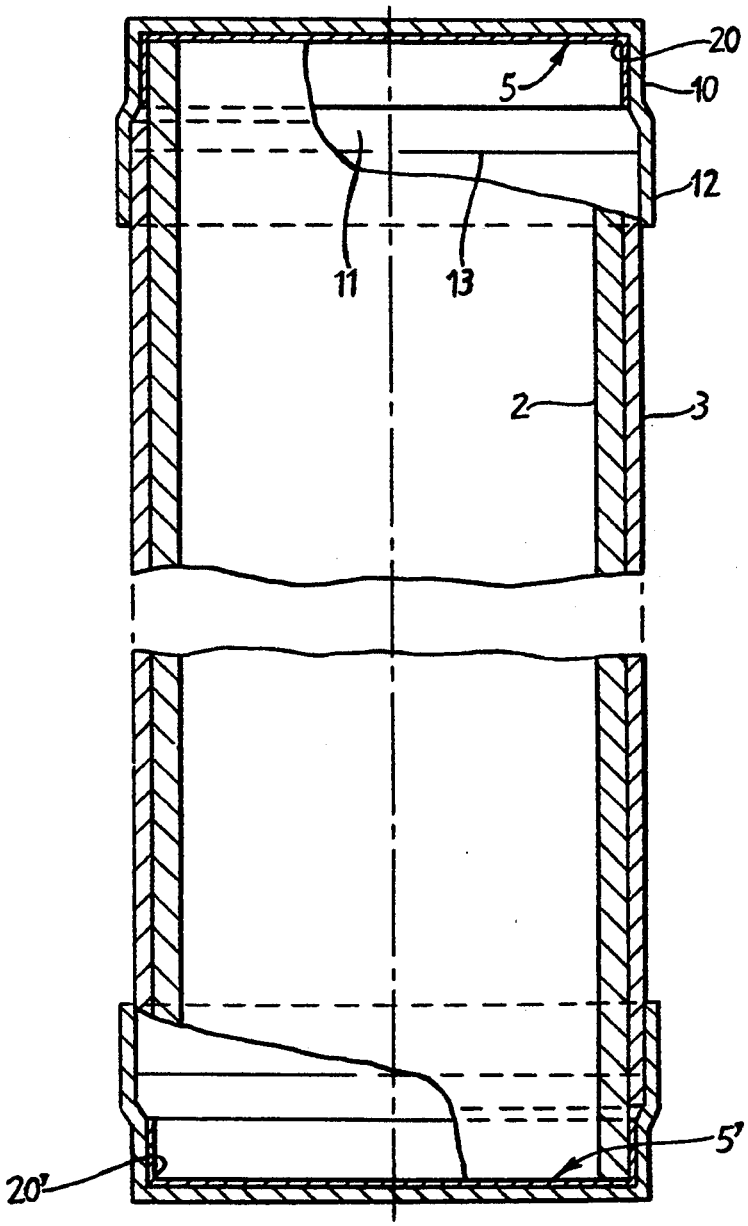
FIG. 7 is a partial cross-sectional cutaway view of both ends of a tube, each end being provided with a blanking-off element.

The breaking of the cap at the level of the bottom wall is here guaranteed by the fact that the cap is obtained by stamping: the line 20 or 20' in FIG. 7 between the bottom wall and the skirt is a zone of less resistance, for example is fragile, typically represented by a radius of 0.1 mm. As a variant, an annular line of less resistance, intended to be broken during launching, may be obtained by any appropriate known means (stippling, notch . . .) which does not prejudice the desired level of protection.

During the breaking of the cap, typically at the level of the bottom wall, the cover swings around the lug which forms a hinge. The retention of the cap by the lug is improved by the fact that, as it is not connected to the cap, the skirt of the cover may contribute by its deformation to the absorption of the ejection energy.

The angular position of the lug is chosen so that, after breaking, the cap and the cover do not obstruct either the sight means or the guide means associated with the tube.

The blanking-off element has a typical resistance to breaking of between 1 bar and 1.5 bar whereas that of the rear element is typically between 1.5 bar and 3.5 bar.

It is obvious that the preceding description has only been proposed as a non-restrictive example and that numerous variants may be proposed by the person skilled in the art without departing from the scope of the invention.

What is claimed is:

1. A blanking-off element adapted to be mounted to one end of a storage and launching tube for a munition said blanking-off element protecting the interior of said tube with respect to external attacks, said blanking-off element comprising;

a cap mounted over said one end of said tube and adapted to be fixed in a tight manner along an edge of said one end of said tube and become detached at least partially with respect to said one end of said tube at the moment of launching of said munition;

a protective cover made from pliable material, said protective cover having an interior,said cap being fixed to said interior of said protective cover; and a retaining lug fixed to the outside of said tube adjacent to said one end;

whereby said cap is recovered at the moment of launching by said protective cover.

2. A blanking-off element as set forth in claim 1 wherein said cap is fixed to said protective cover by an adhesive.

3. A blanking-off element as set forth in claim 2, wherein said adhesive is heat-meltable.

4. A blanking-off element as set forth in claim 1 wherein said protective cover comprises an annular bank surrounding said one end of said tube, said retaining lug being connected to said annular band.

5. A blanking-off element as set forth in claim 4 wherein said protective cover further comprises a frangible zone interconnecting said annular band and said retaining lug.

6. A blanking-off element as set forth in claim 1 wherein said pliable material of said protective cover is thermo-retractable.

7. A blanking-off element as set forth in claim 6 wherein said pliable material is polyethylene.

8. A blanking-off element as set forth in claim 1 wherein said cap is made of an electrically conductive material.

9. A blanking-off element as set forth in claim 8, wherein said electrically conductive material is copper based.

10. A blanking-off element as set forth in claim 1 wherein said cap comprises:

a bottom wall; and a skirt extending from said bottom wall and positioned along the outside of said one end of said tube and fixed thereto.

11. A blanking-off element as set forth in claim 10 wherein said cap is fixed to said protective cover at said bottom wall.

12. A blanking-off element as set forth in claim 10 wherein said cap further comprises an annular zone of lesser resistance located between said bottom wall and said skirt.

13. A blanking-off element as set forth in claim 12 wherein said annular zone of lesser resistance is a right-angled connection zone produced by stamping said cap between said skirt and said bottom wall.

14. An apparatus for the storage and launching of a munition, comprising:

a tube having an outside, a front end and a rear end; and a blanking-off element adapted to be mounted at at least one end of said front and said rear ends of said tube, said blanking-off element comprising:

a cap extending overan entire section of said at least one end and fixed in a tight manner along an edge of said at least one end;

a protective cover made from pliable material; and a lug fixed adjacent to said outside of said tube at said at least one end.

15. An apparatus for the storage and launching of a munition as set forth in claim 14 further comprising a heat-meltable adhesive for adhering said cap to said protective cover.

16. An apparatus for the storage and launching of a munition as set forth in claim 14 wherein said pliable material of said protective cover is thermo-retractable.

17. An apparatus for the storage and launching of a munition as set forth in claim 14 wherein said pliable material is polyethylene.

18. An apparatus for the storage and launching of a munition as set forth in claim 14 wherein said at least one end is said front end, said apparatus further comprising:

a second blanking-off element connected to said rear end, said second blanking-off element comprising:

a cap fixed along an edge of said rear end;

a second protective cover having an interior made from a ;liable material, said cap being fastened to said interior of said second protective cover; and a lug fixed to said outside of said tube adjacent to said rear end.

19. An apparatus for the storage and launching of a munition as set forth in claim 14 wherein said cap further comprises:

a bottom wall; and a skirt extending from said bottom wall and positioned along said outside of said at least one end of said tube and fixed thereto.

20. An apparatus for the storage and launching of a munition as set forth in claim 19 wherein said cap is fixed to said protective cover at said bottom wall of said cap.

21. An apparatus for the storage and launching of a munition as set forth in claim 14 wherein said tube comprises an electrically conductive wall, and further wherein said cap is made from an electrically conductive material and is fixed to said wall of said tube by an electrically conductive adhesive.

22. An apparatus for the storage and launching of a munition as set forth in claim 19 wherein said cap is made of copper.

23. An apparatus for the storage and launching of a munition as set forth in claim 14 wherein said at least one end is said front end of said tube and wherein said protective cover comprises an annular band surrounding said front end of said tube, said lug being connected to said annular band.

24. An apparatus for the storage and launching of a munition as set forth in claim 23 wherein said protective cover and said annular band are connected by frangible zones.

* * * * *

UNITED STATES PATENT AND TRADEMARK OFFICE

CERTIFICATE OF CORRECTION

PATENT NO. : 5,375,503

DATED : December 27, 1994

INVENTOR(S) : Jean-Pierre Breugnot and Jean-Paul Demay

It is certified that error appears in the above-indentified patent and that said Letters Patent is hereby corrected as shown below:

Column 1, line 9, delete "end" insert ---- ends ----.

Column 1, line 40, after "ejection" insert ---- or ----.

Column 3, line 38, delete "cutaway" insert ---- cut-away ----.

Column 3, line 59, delete "third" insert ---- this ----.

Column 3, line 65, after "made" insert ---- from ----.

Column 5, line 7, delete "." insert ---- ; ----.

Column 5, line 51, delete "nm" insert ---- mm ----.

Column 6, line 46, after "munition" insert ---- , ----.

UNITED STATES PATENT AND TRADEMARK OFFICE

CERTIFICATE OF CORRECTION

PATENT NO. : 5,375,503

DATED : December 27, 1994

INVENTOR(S) : Jean-Pierre Breugnot and Jean-Paul Demay

It is certified that error appears in the above-indentified patent and that said Letters Patent is hereby corrected as shown below:

Column 6, line 56, delete ",said" insert ---- , said ----.

Column 7, line 1, delete "bank" insert ---- band ----.

Column 7, line 44, delete "overan" insert ---- over an ----.

Column 8, line 17, delete ";liable" insert ---- pliable ----.

Signed and Sealed this

Eleventh Day of April, 1995

Bruce Lehman

*Attest:*

BRUCE LEHMAN

*Attesting Officer*

*Commissioner of Patents and Trademarks*